US010556354B2

(12) United States Patent
Erndt et al.

(10) Patent No.: US 10,556,354 B2
(45) **Date of Patent: *Feb. 11, 2020**

(54) ELECTRIC SHAVER

(71) Applicant: Braun GmbH, Kronberg (DE)

(72) Inventors: Andreas Erndt, Kelkheim (DE); Philipp Berger, Bad Vilbel (DE); Cirilo Javier Perez Lopez, Frankfurt am Main (DE); Diana Kappes, Boston, MA (US)

(73) Assignee: Braun GMBH, Kronberg (DE)

( * ) Notice: Subject to any disclaimer, the term of this patent is extended or adjusted under 35 U.S.C. 154(b) by 6 days.

This patent is subject to a terminal disclaimer.

(21) Appl. No.: 15/718,368

(22) Filed: Sep. 28, 2017

(65) Prior Publication Data

US 2018/0085937 A1 Mar. 29, 2018

(30) Foreign Application Priority Data

Sep. 28, 2016 (EP) ..... 16191103
Sep. 26, 2017 (EP) ..... 17193261

(51) Int. Cl.

| | |
|---|---|
| ***B26B 19/04*** | (2006.01) |
| ***B26B 19/06*** | (2006.01) |
| ***B26B 19/28*** | (2006.01) |
| ***B26B 19/38*** | (2006.01) |

(52) U.S. Cl.

CPC ..... *B26B 19/046* (2013.01); *B26B 19/048* (2013.01); *B26B 19/063* (2013.01); *B26B 19/288* (2013.01); *B26B 19/384* (2013.01); *B26B 19/386* (2013.01); *B26B 19/3826* (2013.01); *B26B 19/3846* (2013.01); *B26B 19/282* (2013.01); *B26B 19/3873* (2013.01)

(58) Field of Classification Search

CPC ... B26B 19/046; B26B 19/048; B26B 19/063; B26B 19/288; B26B 19/3826; B26B 19/384; B26B 19/3846; B26B 19/386; B26B 19/282; B26B 19/3873

See application file for complete search history.

(56) References Cited

U.S. PATENT DOCUMENTS

| | | | | |
|---|---|---|---|---|
| 9,676,108 | B2 * | 6/2017 | Beugels | B26B 19/048 |
| 2004/0231160 | A1 * | 11/2004 | Shiba | B26B 19/046 30/43.92 |
| 2006/0021228 | A1 | 2/2006 | Shiba et al. | |
| 2009/0056142 | A1 | 3/2009 | Royle et al. | |
| 2011/0094107 | A1 * | 4/2011 | Ring | B26B 19/048 30/43.1 |
| 2016/0151922 | A1 * | 6/2016 | Shimizu | B26B 19/282 30/43 |
| 2018/0085935 | A1 * | 3/2018 | Erndt | B26B 19/046 |
| 2018/0085939 | A1 * | 3/2018 | Krauss | B26B 19/042 |

(Continued)

FOREIGN PATENT DOCUMENTS

| | | |
|---|---|---|
| JP | H0584364 | 4/1993 |
| JP | H10156066 | 6/1998 |

*Primary Examiner* — Omar Flores Sanchez
(74) *Attorney, Agent, or Firm* — Kevin C. Johnson

(57) ABSTRACT

The invention refers to an electric shaver comprising a shaver housing, a shaver head and at least one cartridge mounted in or on said shaver housing. The adaption of the cutter element to the contour of the skin to be shaved is improved by permitting at least one additional movement of the at least one cutter unit relative to the shaver head.

16 Claims, 5 Drawing Sheets

(56) References Cited

U.S. PATENT DOCUMENTS

| | | | | |
|---|---|---|---|---|
| 2018/0085948 | A1* | 3/2018 | Krauss | B26B 19/048 |
| 2018/0085951 | A1* | 3/2018 | Krauss | B26B 19/3893 |
| 2018/0085956 | A1* | 3/2018 | Bady | B26B 19/143 |
| 2018/0333874 | A1* | 11/2018 | Shimizu | B26B 19/146 |

* cited by examiner

ELECTRIC SHAVER

FIELD OF THE INVENTION

The present invention relates to an electric shaver comprising a shaver housing, a shaver head attached to the housing and at least one cartridge mounted in or on said shaver head. The cartridge comprises at least one cutter unit with a first cutter element and a second cutter element which are movable relative to each other in an oscillating manner along a first horizontal cutter oscillation axis. Each cutter unit is mounted in the cartridge pivotably about a second horizontal tilting axis and axially displaceable parallel to a vertical axis. The first horizontal cutter oscillation axis is perpendicular to the vertical axis and perpendicular to the second horizontal tilting axis. Further, the vertical axis is perpendicular to the second horizontal tilting axis. C Regarding the orientation of the axes of an electric shaver, it is assumed in the following that the shaver is held in an upright position with the housing in the form of a body or handle of the shaver facing downwards and a cutter unit facing upwards. With this orientation of the shaver, the vertical axis extends along the body or handle in a vertical direction, while the tilting axis and the cutter oscillation axis extend horizontally. Notwithstanding this definition of the axes, the shaver may be held and applied in any desired orientation during use.

BACKGROUND OF THE INVENTION

The present invention aims in particular to an electric shaver of the type having at least one cutter unit with a foil type upper cutter and a non-foil type lower cutter which perform a reciprocating relative movement with respect to each other when in use. In electric shavers of this type there is a general desire for adapting the cutter unit to the contour of the skin to be shaved. This is achieved by allowing a relative movement of the cutter unit with respect to the main housing or a handle of the electric shaver.

Various types of electric shavers are known allowing such a relative movement of the cutter unit with respect to the main housing. For example, EP 2 004 364 B1 discloses an electric shaver with a housing comprising a drive motor and a shaving head connected to the housing for pivotal movement about a pivot axis which is parallel to direction of the oscillating movement of cutters. The shaving head mounts two shaving systems, each comprised of an outer cutter and associated under cutters. The under cutters are adapted to be driven in an oscillatory linear motion relative to the outer cutter. The under cutters are mounted respectively on separate oscillatory elements in the shaving head. The oscillatory elements are each connected to the drive motor via drive elements and are driven in mutually opposite directions. One example uses a con-rod mounted to an eccentric portion of a drive shaft for driving an oscillatory bridge which in turn transmits the reciprocating translational movement to a lower cutter element. The con-rod comprises a pin engaging a slot in the oscillatory bridge which slot extends perpendicular to the horizontal (swiveling) axis. An alternative example uses pin-shaped oscillators which are each coupled via a joint pushrod to an oscillatory plate which in turn transmits the reciprocating translational movement to a lower cutter element. Both examples allow swiveling of the shaver head with respect to the shaver housing while transmitting a movement to the lower cutter element. Further electrical shavers allowing pivoting about a pivot axis parallel to direction of the oscillating movement of cutters are known from EP 0 618 853 B1 and EP 2 035 195 B1.

Further, EP 1 017 546 B1 shows a shaver with a shearing blade which is arranged in a pivotable head frame and cooperates with knives oscillating in the longitudinal direction of the shearing blades. The head frame is detachably connected with a base part including the drive. The head frame is designed in two parts comprising an external head part carrying the shearing blade and a part detachably fixed to the base part, wherein the external head part is connected with the head frame part detachably fixed to the base part, in a manner so as to be pivotable about an approximately central pivot axis extending transverse to the oscillation direction of the knives. Further examples of a shaver allowing pivoting of about an axis extending transverse to the oscillation direction of the knives are disclosed in EP 2 435 218 A1 and GB 22 66 070 A.

EP 1 161 325 B1 suggests an electric shaver with oscillating cutting knifes which move relative to a shearing blade. A shearing head carrying the shearing blade is driven by a drive unit to perform a gyration or tilting movement.

In RU 2 175 911 C a shaver of the type with rotating blades is described. A supporting ring is joined with a holder by means of cross like cardan-joint such that the supporting ring may perform a rocking motion in any direction relative to a cutting head. Further, EP 2 208 589 B1 discloses an electric shaver comprising a head part swingably attached to a body part. The head part includes a shaving portion having paired blades and a drive mechanism configured to drive at least one of the paired blades. An interposer is provided configured to support the head part on the body part swingably about a first swing axis and swingably about a second swing axis orthogonal to the first swing axis.

EP 1 728 603 B1 describes a shaver with a head portion and a main body grip portion which supports the head portion in a manner that the head portion can vertically float and tilt. Further, WO 03/026854 A1 suggests a reciprocation type electric shaver which comprises a main body block and a head block. The main body block has independently vertically movable head support members at a total of four places and head float springs for upwardly urging these head support members for floating. Upper ends of head support members on the main body block side are longitudinally turnably connected to rotary connecting portions at four places, respectively, around the transverse axis of the main body, thus allowing the head block to swing longitudinally with respect to the main body block.

Due to the requirement that the cutter element of the shaver has to be coupled to a drive unit for transmitting a driving force or movement, the degree of such a relative movement of the cutter unit with respect to the housing is facing constraints. It is accordingly an object of the present invention to propose an electric shaver of the type mentioned above which improves the ability of adaption to the contour of the skin to be shaved.

SUMMARY OF THE INVENTION

This object is solved with an electric shaver according to claim 1.

This is addressed by an electric shaver comprising a shaver handle housing, a shaver head housing coupled with said shaver handle housing, said shaver head housing being provided with at least one wing or cartridge, wherein the wing comprises at least one cutter unit with a first cutter element and a second cutter element, said shaver handle comprising a motor, said motor being coupled with a drive unit for driving either said first cutter element and/or said second cutter element in an oscillating manner along a first horizontal cutter oscillation axis, wherein said at least one cutter unit is arranged in the at least one wing wherein said shaver head is tiltably supported by said shaver handle about a second horizontal tilting axis wherein the first horizontal cutter oscillation axis being perpendicular to a vertical axis and perpendicular to the second horizontal tilting axis and wherein the at least one wing is supported pivotably relative to the shaver head housing about the first horizontal cutter oscillation axis or a third horizontal axis parallel to said first horizontal cutter oscillation axis.

According to a still further embodiment said shaver head housing comprises two wings each being provided with at least one cutter unit said wings are pivotably supported within said shaver head housing around said third horizontal axis such that both wings swivel dependent together or independently form each other. Thus both wings may swivel like a butterfly around said third horizontal axis.

According to a still further embodiment said at least one cutter unit is moveably supported within the at least one wing. Such cutter unit movability allows for micro skin contour adaption while the macro adaption is implemented by the tiltability of the head and the swivel movement of the cartridge/wing relative to the head.

The ability of adaption to the contour of the skin to be shaved by mounting, i.e. supporting, guiding and/or attaching is increased if the at least one cutter unit in or on the shaver head such that the cutter unit is movable with an additional degree of freedom. That is the cutter unit is permitted to be displaced (longitudinally) and/or to be pivoted (rotationally) relative to the shaver head in addition to the cutter unit being permitted to pivot about the second horizontal tilting axis relative to the shaver head and being permitted to displace axially parallel to the vertical axis relative to the shaver head.

The cartridge or wing may be a frame or a cassette holding and/or guiding the at least one cutter unit. A cutter unit may be movable relative to the cartridge and/or may be movable together with the cartridge relative to the shaver head. A movement of a cutter unit relative to the cartridge and/or relative to the shaver head is a movement relative to the shaver housing unless a superimposed movement of the cartridge and/or the shaver head relative to the shaver housing compensates the relative movement of the cutter unit.

Preferably, a cutter unit is pivotable with respect to the shaver housing and/or with respect to the shaver head about two different horizontal axes and is additionally axially displaceable parallel to the vertical axis. The ability of adaption to the contour of the skin to be shaved is further increased by mounting a cutter unit such that it is pivotable about the second horizontal tilting axis with respect to the cartridge and by mounting the cartridge such that it is pivotable about the second horizontal tilting axis with respect to the shaver housing and/or with respect to the shaver head. Thus, the maximum angular displacement of the cutter unit with respect to the housing is relatively large while the individual angular displacement between the cutter unit and the cartridge and between the cartridge and the shaver housing and/or the shaver head may be relatively small. Further, the angular displacement between a cutter unit and the cartridge may be at least partially compensated by an opposite angular displacement between the cartridge and the shaver housing and/or the shaver head. The latter case is especially beneficial if two or more cutter units are provided within a cartridge which units are allowed to move individually with respect to the cartridge.

The electric shaver may comprise at least one elastically deformable biasing element which biases the second cutter element at least in a direction parallel to the vertical axis into a home position. The biasing element may be a spring, for example a compression spring or a leg spring. In addition, the biasing element or a further biasing element may bias a cutter element and/or a cutter unit into a home position with respect to pivoting about the first horizontal cutter oscillation axis and/or with respect to the second horizontal tilting axis. In such a home position the possible movements of the cutter unit are preferably visible for a user to understand the possibilities of adaption to the skin. An individual suspension of the cartridge or its component parts results in an improved orientation of a cutter unit with respect to the skin. This permits an adaption to concave and convex skin contours, thereby resulting in an improved shaving performance.

The mounting of the cutter unit with respect to the housing and/or with respect to the shaver head reduces the number and complexity of the component parts compared with known shaver head designs. This leads to reduced reduction costs.

If two cutter units are provided the movement of the cutter elements within the cutter units may be in the opposite direction to reduce the vibration of the electric shaver.

It is preferred to provide component parts which are liable to wear in exchangeable units, for example exchangeable cutter units and/or an exchangeable cartridge and/or an exchangeable shaver head. Thus, the design of the exchangeable component parts may be further simplified and adapted to the service life of the cutter elements. Reduced masses of the moving component parts result in a minimized surface pressure and, thus, in minimized wear.

The design of the shaver according to the present invention further reduces the length of the drive train which makes the drive train differ and improves the shaver performance.

According to a preferred embodiment of the present invention the at least one cartridge of the electric shaver comprises at least two cutter units wherein each cutter unit is mounted in a cartridge individually pivotably about the second horizontal tilting axis and individually axially displaceably parallel to the vertical axis. Individual movements of the cutter units within the cartridge result in an increased degree of freedom of the cutter units to permit individual adaption to the contour of the skin to be shaved. This may result in movements of the cutter units with respect to the cartridge in opposite directions.

As an alternative to the above embodiment, the at least one cartridge may comprise at least two cutter units which are coupled with each other such that pivoting about the second horizontal tilting axis and/or displacement parallel to the vertical axis of a first cutter unit mounted in said cartridge causes pivoting about the second horizontal tilting axis and/or displacement parallel to the vertical axis of a further cutter unit mounted in said cartridge. In other words, the cutter units may be linked with each other such that the movement of one cutter unit with respect to the cartridge results in a movement of the other cutter unit within said cartridge. This may be an identical movement or a different movement, for example an opposite movement.

The cartridge of the electric shaver may be designed as a single unit, i.e. as a single component part or as multiple component parts which act as a single component part. As an alternative, the cartridge may be divided into at least two portions which are coupled moveably with respect to each other, wherein each portion comprises at least one cutter unit. In the latter case movement of the cartridge portions with respect to the housing and/or shaver head results in movement of a cutter unit with respect to the housing and/or with respect to the shaver head.

According to an embodiment of the invention the cartridge may be fixed directly on the shaver housing and/or on the shaver head. Preferably, the cartridge is releasably fixed in the shaver housing. For example, the cartridge with the at least one cutter unit may be exchangeable by removing same from the shaver housing and replacing it by any new cartridge with at least one cutter unit. In this respect, the term "fixed" shall not be limited to a stiff mounting of the whole cartridge with respect to the shaver housing but is rather to be understood as being fixed with one or more bearings while being pivotable with respect to the shaver housing.

In addition or as an alternative, the cartridge may be mounted in a shaver head which in turn is mounted on the shaver housing. This includes embodiments with the cartridge rigidly fixed within the shaver head and embodiments with the cartridge being moveable with respect to the shaver head. Preferably, the shaver head is mounted on the shaver housing pivotably about the first horizontal cutter oscillation axis.

At least one cutter unit of the electric shaver comprises a first cutter element which is foil type cutter element and a second cutter element which is a (none-foil type) blade type cutter element. Additional cutter units of the same type or of a different type may be provided. Further, the electric shaver may be provided with an element for heating or cooling the skin to be shaved.

The shaver housing preferably encases a power source, like a battery, preferably a rechargeable battery, and may further comprise a drive unit which is located at least in part within the shaver housing. The drive unit may comprise an electric motor and for example an eccentric for generating an oscillating movement for the at least one drive unit. A transmission pin or the like of the drive unit may extend out of the shaver housing to be coupled to component parts within the shaver head, cartridge and/or drive unit.

According to a preferred embodiment of the invention the drive unit is coupled to the second cutter element by means of a coupling suitable to transmit a driving force and/or movement from the drive unit to the cutter unit. In more detail, the coupling may comprise a transmitter, the second cutter element and a coupling part, which coupling part comprises a seat for receiving the transmitter. The transmitter, the cutter element and the coupling part are preferably arranged and formed such that the transmitter is constrained to the cutter element in a direction parallel to the first horizontal cutter oscillation axis while having a degree of freedom in at least two rotational directions and in at least one translational direction parallel to the vertical axis. This allows transmission of a driving force and/or movement from the transmitter to the cutter element while allowing pivoting of the cutter element with respect to the housing as described above.

Preferably, the transmitter is rotatable relative to the coupling part around the vertical axis and the coupling part is rotationally constrained to the second cutter element in the rotational direction around the vertical axis. This holds the coupling part in a predefined orientation with respect to the cutter element. The coupling part preferably comprises an at least in part spherical or cylindrical outer surface with the second cutter element comprising a corresponding at least in part spherical or cylindrical inner surface. This design of the second cutter element and the coupling part permits the relative movements of the cutter element with respect to the housing as mentioned above. The interface between the transmitter, the coupling part and the cutter element may comprise various different designs. For example, the seat of the coupling part may be a slotted whole having a width in the direction of the first horizontal cutter oscillation axis which corresponds to the width of the transmitter pin in the direction of the first horizontal cutter oscillation axis and having a width in the direction of the second horizontal tilting axis which exceeds the width of the transmitter pin in the direction of the second horizontal tilting axis. The coupling part and the cutter element may comprise corresponding guide elements preventing relative rotation around the vertical axis to maintain a predefined orientation. As an alternative, the seat of the coupling part may be a cylindrical hole having a diameter which corresponds to the diameter of the transmitter pin, wherein the cutter element comprises a cylindrical inner face defined by a longitudinal axis which is parallel to the second horizontal tilting axis.

As a further alternative, the coupling part may comprise a bearing shell receiving the free and of the transmitter wherein the bearing shell is mounted to the second cutter element via a con-rod which is pivotable about an axis perpendicular to the first horizontal cutter oscillation axis and perpendicular to the vertical axis. The pivoting movements of the cutter element with respect to the transmitter pin are permitted by the design of the bearing shell. An elastically deformable lack spring may be provided biasing the bearing shell away from the cutter element. This holds the bearing shell in contact with the tip of the transmitter pin while allowing axial movement of the cutter element with respect to the transmitter pin parallel to the vertical axis.

The at least one cutter unit is preferably gimbal-mounted on the shaver housing. This includes embodiments with the cutter unit being directly gimbal-mounted on the shaver housing by a cardan suspension and embodiments with the cartridge and/or shaver head being gimbal-mounted on the shaver housing and/or with the cutter unit being gimbal-mounted within the cartridge and/or shaver head. The shaver may comprise a housing, e.g. in the form of a body or handle, a shaver head, and a gimbal element which is hinged in a pivotable manner to the housing and which is hinged in a pivotable manner to the head. Preferably, the gimbal element is mounted to the housing by means of a joint allowing rotation about the cutter oscillation axis and is mounted to the shaver head by means of a joint allowing rotation about the tilting axis.

According to a still further embodiment of the present invention the at least one cutter unit may be mounted to the shaver housing by elastically deformable connecting elements. For example, a rubber-like suspension may be provided between the at least one cutter unit and the shaver housing.

Further features, advantages and possibilities of use of the present invention are described in the sub claims and in the following with respect to preferred embodiments of the invention and the drawings. All features described and/or shown in the drawings are subject matter of the invention, irrespective of the grouping of the features in the claims and/or their back references.

DETAILED DESCRIPTION OF THE INVENTION

Figure 1:
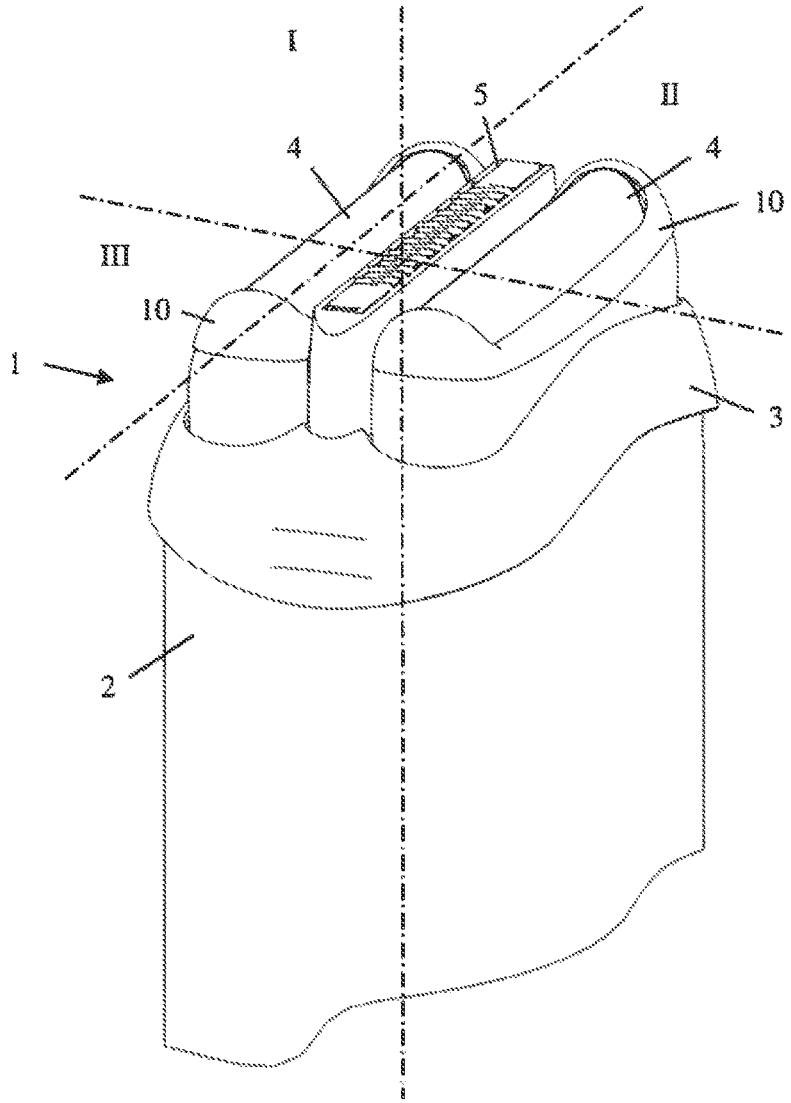
FIG. 1 is a perspective partial view of an electric shaver.

FIG. 1 depicts the upper portion of an electrical shaver 1 with a shaver housing 2 forming a handle for holding the shaver 1 and a shaver head 3 detachably mounted on the housing 2. The shaver housing 2 may have different shapes such as a substantially cylindrical shape or box shape or bone shape allowing for ergonomically grabbing and holding the shaver. In the exemplary embodiment of FIG. 1, the shaver head 3 comprises three cutter units, namely two outer shearing foil cutter units 4 and a central shearing blade cutter unit 5. Other embodiments may comprise different types of cutter units, different numbers of cutter units and/or a different arrangement of the cutter units.

FIG. 1 further shows three axes which are each arranged perpendicular to each other, namely a vertical axis I, a first horizontal axis II (also referred to as cutter oscillation axis in the following) and a further horizontal axis III (also referred to as tilting axis in the following). The six degrees of freedom of a body are referred to in the following with reference to these axes as:

- vertical translation, i.e. parallel to the vertical axis I,
- lateral horizontal translation, i.e. parallel to the cutter oscillation axis II,
- forward horizontal translation, i.e. parallel to the tilting axis III,
- gyration, i.e. a rotation about an axis parallel to the vertical axis I,
- swiveling, i.e. a rotation about an axis parallel to the cutter oscillation axis II,
- tilting, i.e. a rotation about an axis parallel to the tilting axis III, If not defined otherwise in the following, any of these movements are to be understood as movements relative to the housing 2 as a stationary basis.

Figure 2A:
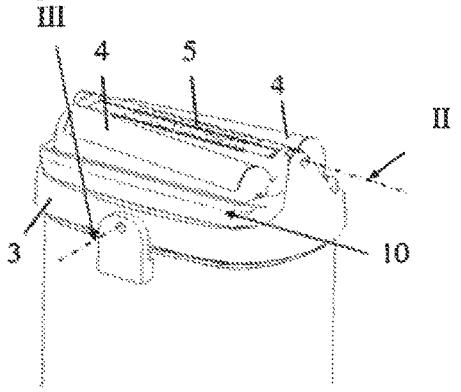
FIG. 2*a, b* are perspective partial views of an electric shaver according to a first embodiment of the invention.
Figure 2B:
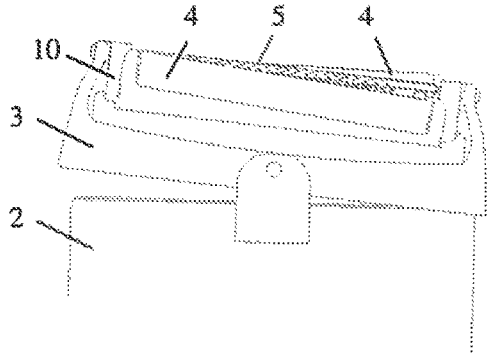

FIGS. 2*a* and 2*b* depict the upper portion of an electric shaver 1 having the shaver head 3 pivotably mounted on the shaver housing 2 by means of a joint permitting pivoting about the horizontal tilting axis III. The shaver head 3 comprises a further joint in which a cartridge 10 or wing 10 is mounted pivotably about the cutter oscillation axis II. Two shearing foil cutter units 4 and a central shearing blade cutter unit 5 are provided within the cartridge. At least the shearing foil cutter units 4 are mounted moveable with respect to cartridge 10 permitting pivoting about the tilting axis III with respect to the cartridge and permitting a vertical translation with respect to cartridge parallel to the vertical axis I.

The embodiment of FIGS. 2*a* and 2*b* shows the cartridge 10 as a unit which is pivotable with respect to the shaver end as a single component part. In addition, the cutter units are coupled to each other by the cartridge 10 such that they move together with the cartridge.

Figure 3A:
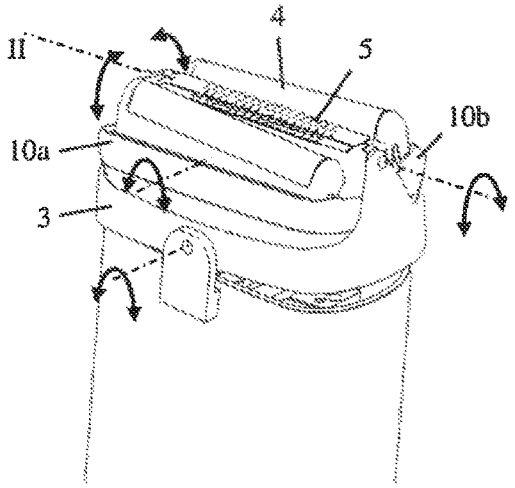
FIG. 3*a, b* are perspective partial views of an electric shaver according to a second embodiment of the invention.
Figure 3B:
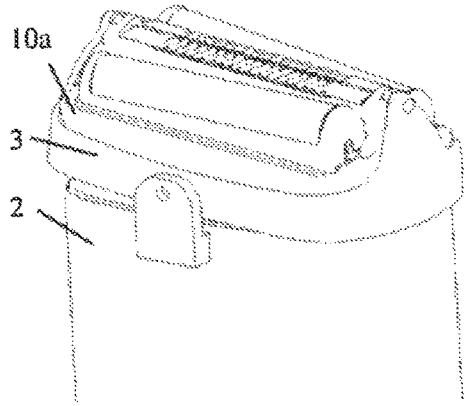

FIGS. 3*a* and 3*b* show a similar embodiment regarding the arrangement of the shaver head 3 which is pivotable about the tilting axis III with respect to the housing 2. In this second embodiment the cartridge is split into two cartridge portions or wings 10*a*, 10*b* which are pivotably mounted in shaver head 3 to allow swiveling about the cutter oscillation axis II. The cartridge may either be designed such that each cartridge portion 10*a*, 10*b* is pivotably independent of the other cartridge portion or such that pivoting of one cartridge portion causes pivoting of the other cartridge portion in the opposite direction. In addition, FIG. 3*b* shows that pivoting of the cutter units 4 about the tilting axis III is permitted in opposite directions by individually mounting the cutter units within the cartridge portions 10*a*, 10*b*.

Figure 4A:
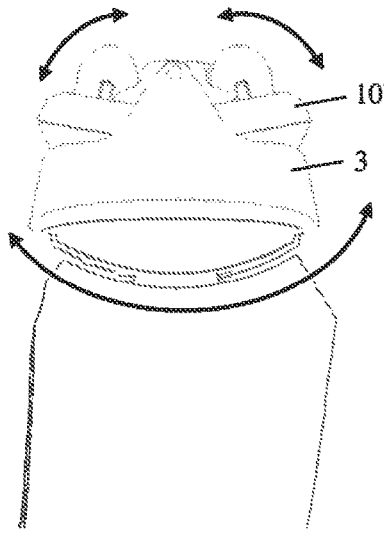
FIGS. 4*a*-4*c* are partial views of an electric shaver according to a third embodiment of the invention.
Figure 4B:
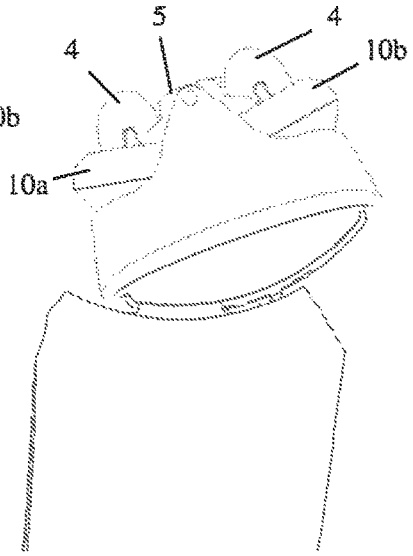
Figure 4C:
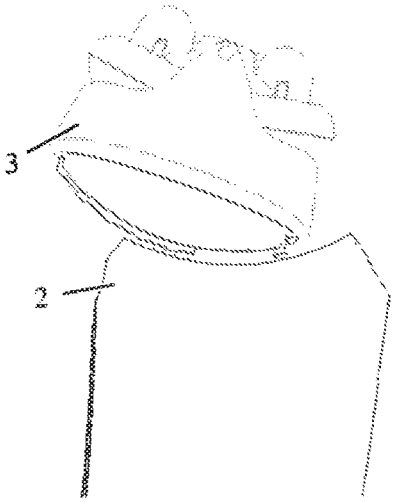

In the embodiment of FIGS. 4*a* to 4*c* the shaver head 3 is pivotable about the cutter oscillation axis II with respect to the housing 2. Further, the cartridge portions 10*a*, 10*b* are pivotable about an axis parallel to the cutter oscillation axis II as indicated by the arrows. In addition, the cutter units 4 may be moved with respect to the cartridge 10 and/or the shaver head 3 as mentioned above, i.e. permitting pivoting of the cutter units 4 about the second horizontal tilting axis III relative to the shaver head 3 and permitting axial displacement parallel to the vertical axis I relative to the shaver head 3. The rotational movement of the cutter units 4 relative to the shaver head 3 may be an individual movement of each cutter unit 4 and/or of each cartridge portion 10*a*, 10*b*. As an alternative, the cutter units 4 and/or the cartridge portions 10*a*, 10*b* may be coupled to each other such that a movement of one cutter element 4 causes an identical or different, e.g. opposite, movement of the other cutter element 4.

Figure 5A:
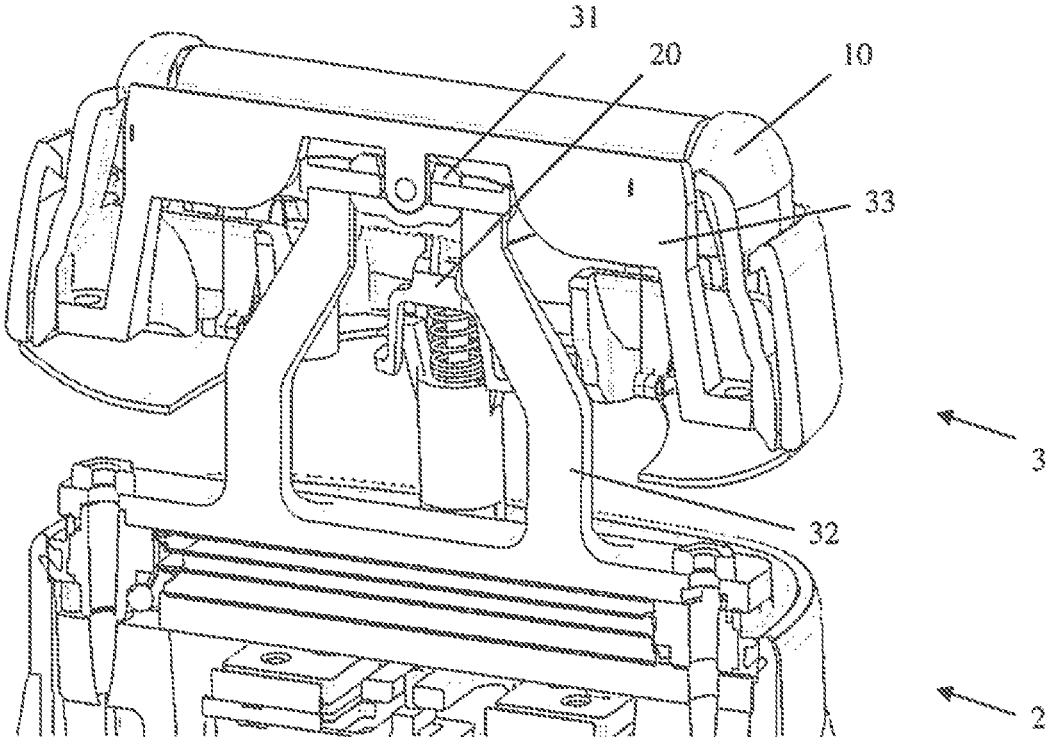
FIG. 5*a*, 5*b* are views of an electric shaver according to a fourth embodiment of the invention.
Figure 5B:
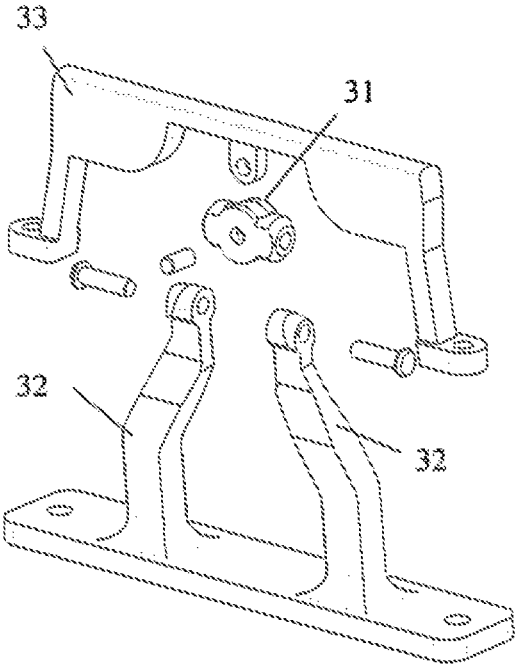

FIGS. 5*a* and 5*b* show a cutter unit 4 gimbal-mounted within the shaver by means of a cardan joint. In more detail, shaver head 3 may be mounted on housing 2 of the shaver 1 by means of a gimbal element 31. The gimbal element 31 is pivotably mounted on arms 32 fixed to the housing 2 and the head 3 is in turn pivotably mounted by means of a frame 33 on the gimbal element 31. In the embodiment of FIGS. 5*a* and 5*b*, the gimbal element 31 is rotatable about horizontal cutter oscillation axis II with respect to arms 32 of the housing 2. Further, the head 3 and its frame 33 are rotatable about horizontal tilting axis III with respect to gimbal element 31. In this embodiment, the rotation axes are implemented on the same part creating a very compact design. The implementation of this cardan joint in between the shaving foils allows at the same time to have the rotation axis close to the contact surface to the skin and therefore obtain the ergonomic benefits. In addition, this compact design minimizes the size of the shaver head 3. As an alternative to the configuration with the cardan joint a cutter unit may be mounted using soft components interposed between stiffer component parts to allow a degree of flexibility.

In the following, exemplary embodiments of the interface between the drive unit of the electric shaver and the cutter element are shown.

Figure 6A:
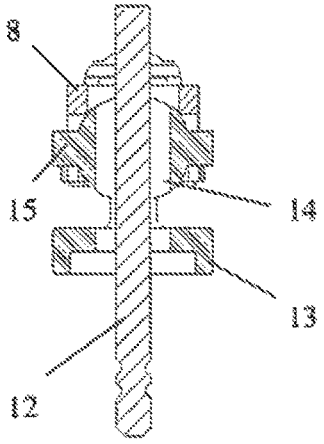
FIG. 6*a, b* are sectional views of a detail of a shaver head according to a fifth embodiment of the invention.
Figure 6B:
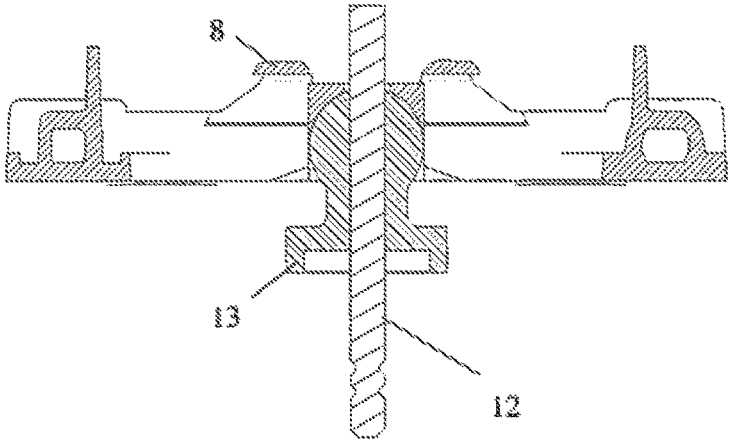

The general principle of transmitting a force or motion to the cutter units 4 can be understood from FIGS. 6*a* and 6*b*. Each cutter unit 4 comprises a blade type lower cutter element 6 with a series of arched blades 7 (FIGS. 8*a*, 9) mounted on a common base 8 and a foil type upper cutter element 9 which is mounted in cartridge 10. The cartridge 10 further guides the lower cutter element 6 allowing relative lateral horizontal translation of the lower cutter element 6 with respect to the stationary upper cutter element 9 parallel to the swiveling axis II while constraining the lower cutter element 6 in a defined position with respect to the upper cutter element 9 in a direction parallel to the vertical axis I and in a direction parallel to the tilting axis III. This reciprocating relative movement of the two cutter elements shears off hairs entering the openings in the foil type upper cutter element 9.

The cartridge 10 is guided in the shaver head 3 by means of two pins 11 (FIG. 9) allowing vertical translation and tilting of the cartridge 10 with respect to the shaver head 3. The housing 2 encases a drive unit (not shown) which may comprise an electric motor with an eccentric driving an oscillating bridge (not shown) carrying at least one transmitter 12 which performs a reciprocating lateral horizontal translation. The transmitter 12 may have the form of a pin extending parallel to the vertical axis I as shown in FIGS. 6*a* and 6*b*.

Further, FIGS. 6*a* and 6*b* depict a first embodiment of a coupling between the transmitter pin 12 and the lower cutter element 6. The coupling comprises the transmitter pin 12 and the lower cutter element 6 and in addition a coupling part 13 which is interposed between the transmitter pin 12 and the lower cutter element 6. The coupling part 13 has an at least partially spherical upper portion which is guided in a corresponding hemispherical portion of the base 8 of the lower cutter element 6. The lower portion of the coupling part 13 has a flange-like configuration and is adapted to receive a compression spring (not shown) for pushing the coupling part 13 upwards.

Further, the coupling part 13 comprises a seat for receiving the transmitter pin 12 which has the form of a slotted hole 14. The dimensions of the slotted hole 14 are adapted to the dimension of the transmitter pin 12 such that the width of the slotted hole 14 substantially corresponds to the width of the transmitter pin 12 in a direction parallel to the horizontal cutter oscillation axis II whereas the width of the slotted hole 14 exceeds the width of the transmitter pin 12 in the perpendicular direction parallel to the horizontal tilting axis III. The fit between the transmitter pin 12 and the slotted hole 14 in the direction parallel to the horizontal cutter oscillation axis II is preferably chosen such that the transmitter pin 12 is able to slide within the slotted hole 14 in a direction parallel to the vertical axis I but has substantially no play to provide for transmission of a force or motion in the direction parallel to the horizontal cutter oscillation axis II for driving the lower cutter element 6 upon actuation of the transmitter pin 12. On the other hand, the increased width of the slotted hole 14 in the direction parallel to the horizontal tilting axis III allows pivoting of the coupling part 13 with respect to the transmitter pin 12, in particular if the cutter unit 4 performs a swiveling motion relative to the transmitter pin 12.

The above features of transmitting a force or motion in a direction parallel to the horizontal cutter oscillation axis II while allowing a swiveling of the cutter unit with respect to the transmitter pin 12 requires that the coupling part 13 is held in a predefined orientation with respect to the transmitter pin and/or the lower cutter element 6. This is achieved by providing two lateral guiding elements in the form of pins 15 on the spherical portion of coupling part 13. The guide pins 15 are received in a corresponding structure in base 8 of the lower cutter element 6 to prevent gyration of the coupling part 13 with respect to the base 8. In other words, the orientation of the slotted hole 14 with respect to the base 8 of the lower cutter element 6 is maintained by the guide pins 15 and the corresponding structure in the base 8.

The coupling between transmitter pin 12 and lower cutter element 6 by means of coupling part 13 has the effect that a reciprocating force or motion of the transmitter pin 12 for driving the lower cutter element 6 is directly transmitted from the transmitter pin 12 via the slotted hole 14 of the coupling part 13 and via the spherical outer surface of coupling part 13 into the corresponding hemispherical surface of base 8 of the lower cutter element 6. In addition, the lower cutter element 6 may perform a relative movement parallel to the vertical axis I with respect to transmitter pin 12 by transmitter pin 12 sliding within slotted hole 14 of coupling part 13. The structure of the spherical outer surface of coupling part 13 and the corresponding hemispherical surface of base 8 allow a tilting of the lower cutter element 6 with respect to the transmitter pin 12. The design of the slotted hole 14 further allows swiveling of the lower cutter element 6 with respect to transmitter pin 12. Further, a gyration of the lower cutter element 6 with respect to the transmitter pin 12 is allowed. In addition, the design and orientation of the slotted hole 14 allows a relative movement of the lower cutter element 6 with respect to transmitter pin 12 parallel to the horizontal tilting axis III. The latter two relative movements of the lower cutter element 6 with respect to the transmitter pin 12 may be prevented by the cartridge 10 being guided on pins 11 of the shaver head 3.

Figure 7A:
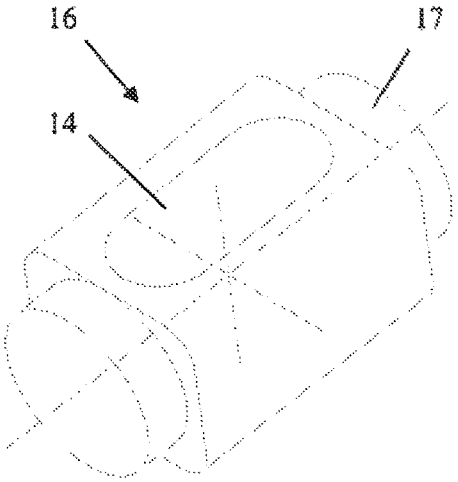
FIG. 7*a* is a perspective view of a coupling part of a shaver head according to a sixth embodiment of the invention.
Figure 7B:
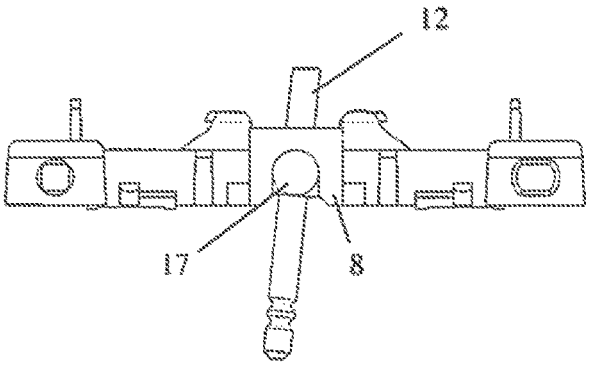
FIG. 7*b* is a side view of a detail of a shaver head with the coupler part of FIG. 7*a;*

A further embodiment of the present invention is depicted in FIGS. 7*a* and 7*b*. The general composition and function of the respective component parts is identical to the above described first embodiment. However, the design of the coupling part 16 and the respective counter surface in base 8 of the lower cutter element 6 differs from the design of the coupling part 13 of the previous embodiment and the respective counter surface in the base 8. As can be seen in FIG. 7*a* coupling part 16 is substantially cylindrical with a middle portion in the form of a cuboid with rounded edges. The lateral cylindrical portions 17 of coupling part 16 are received and guided in a corresponding surface of base 8 of the lower cutter element 6. As can be seen from FIG. 7*b* this corresponding surface may have the form of a cylindrical half shell such that tilting of the lower cutter element 6 with respect to transmitter pin 12 is allowed. In addition, the lateral cylindrical portions 17 of coupling part 16 fulfill the function of the guide pins 15 of coupling part 13 of the first embodiment, i.e. preventing gyration of the coupling part 16 with respect to the lower cutter element 6.

The coupling part 16 further comprises a slotted hole 14 which has a configuration and orientation as mentioned above with respect to the first embodiment. The transmitter pin 12 is guided within the slotted hole 14 of coupling part 16 such that a driving force or motion in a direction parallel to the horizontal cutter oscillation axis II is transmitted, while relative movement in the direction of the perpendicular horizontal tilting axis III or a relative swiveling movement are permitted by the design of the slotted hole 14.

The design and arrangement of the coupling between transmitter 12 and lower cutter element 6 by means of coupling part 16 is such that only one degree of freedom is constrained, namely the lateral horizontal translation parallel to the cutter oscillation axis II, while the five other relative movements, namely the vertical translation, the forward horizontal translation, the gyration, the swiveling and the tilting, are permitted. Due to the interface between shaver head 3 and cartridge 10 with pins 11 engaging a fixed bearing 18 and a floating bearing 19 gyration and forward horizontal translation between the cutter unit 4 and the transmitter pin 12 are prevented. However, the design of the second embodiment may be amended to allow gyration and/or forward horizontal translation if desired.

Figure 8A:
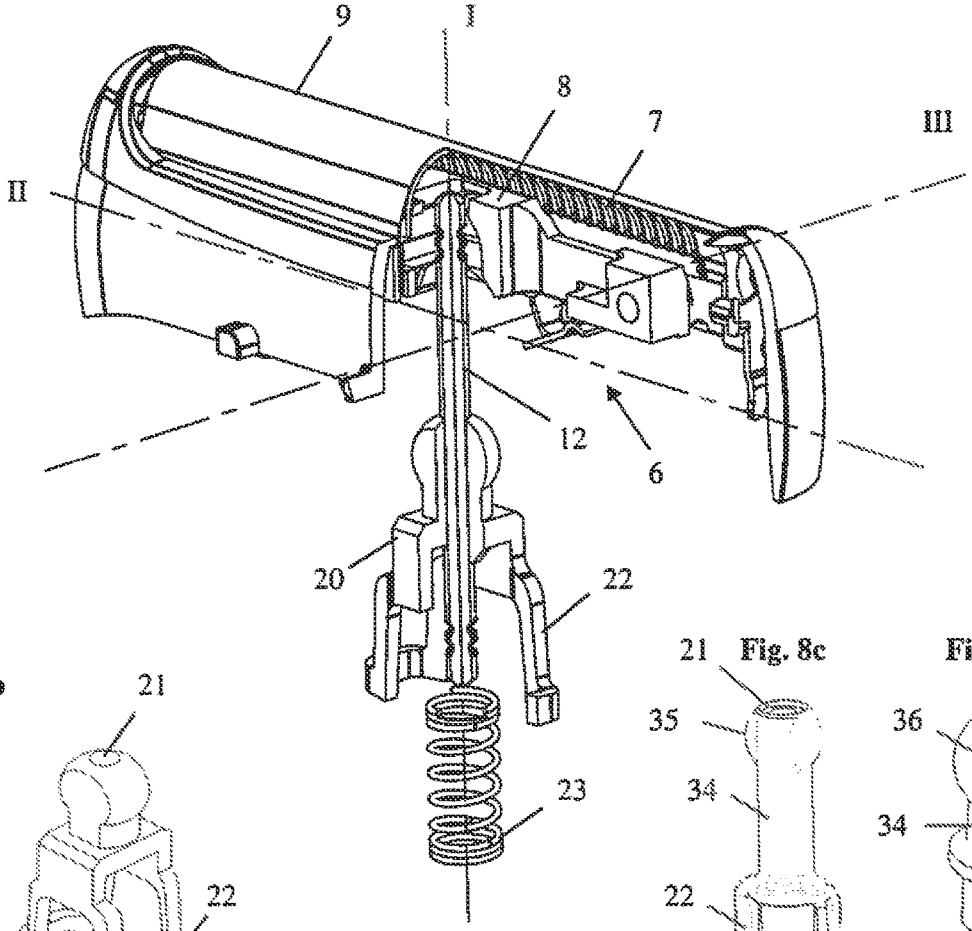
FIG. 8*a* is a perspective partial view of a shaver head according to a seventh embodiment of the invention.
Figure 8B:
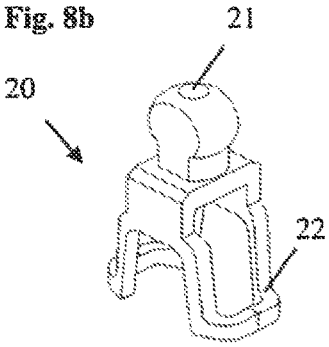
FIG. 8*b* is a perspective view of the coupling part of the shaver head of FIG. 8*a;*

A still further embodiment of the invention is depicted in FIGS. 8*a* and 8*b*. Again, the general composition and function of the shaver head is as described above with respect to the previous embodiments. The coupling between transmitter pin 12 and the lower cutter element 6 comprises a coupling part 20 with a spherical upper portion which may have flattened lateral sides as shown in FIG. 8*b*. This upper portion of coupling part 20 is received in a corresponding structure of the base 8 of the lower cutter element 6 having the form of a cylindrical half shell in the depicted embodiment. The half shell extends with its longitudinal axis parallel to the horizontal tilting axis III. As an alternative to the depicted embodiment a hemispherical configuration of the corresponding structure of the base 8 of the lower cutter element 6 may be possible.

The coupling part 20 comprises a circular hole 21 receiving the transmitter pin 12. The inner diameter of the circular hole 21 substantially corresponds to the outer diameter of transmitter pin 12 to allow direct transmission of a driving force or motion from the transmitter pin 12 to the coupling part 20 and further to the lower cutter element 6 while allowing a sliding vertical translation of coupling part 20 with respect to transmitter pin 12. As an alternative to the circular design of transmitter pin 12 and hole 21 any other design may be possible which allows transmission of a lateral horizontal translation.

The lower portion of coupling part 20 has a flange-like configuration with two legs 22 extending away from the spherical upper portion. As shown in FIG. 8*a* a compression spring 23 may be received in the flange-like portion between legs 22 and surrounding transmitter pin 12. With the shaver head 3 attached to the housing 2 of an electric shaver legs 22 preferably engage hocks (not shown) which may be provided on an oscillating bridge surrounding transmitter pin such that a relative vertical translation of coupling part 20 with respect to the hocks is allowed while preventing gyration of coupling part 20.

Again, the design and arrangement of the coupling of the third embodiment is such that a relative lateral horizontal translation between transmitter pin 12 and lower cutter element 6 is prevented, while a relative vertical translation, a forward horizontal translation, a gyration, a swiveling and a tilting is allowed. As mentioned above, the forward horizontal translation and the gyration may be prevented by means of the interface between cartridge 10 and shaver head 3.

Figure 8C:
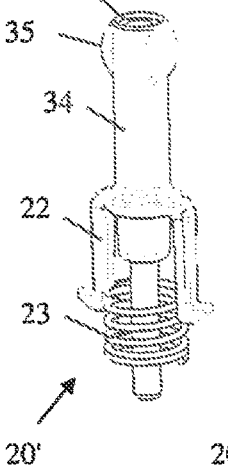
FIG. 8*c* is a perspective view an alternative coupling part of the shaver head of FIG. 8*a;*
Figure 8D:
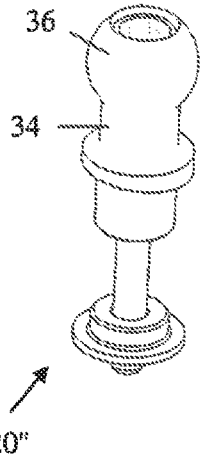
FIG. 8*d* is a perspective view an alternative coupling part of the shaver head of FIG. 8*a;*

Alternative designs of the coupling part 20 are depicted in FIGS. 8*c* and 8*d*. The embodiment of 8*c* shows an amended design of the interface between the coupling part 20' and the cutter element 6. In more detail, the coupling part 20' comprises a neck portion 34 which may be cylindrical as shown in FIG. 8*c*. The upper end (as seen in FIG. 8*c*) of the neck portion 34 is provided with two laterally extending protrusions 35 in the form of arcs each forming a cylinder segment. The cutter element 6 (not shown) may be provided with a corresponding guidance chamber having two opposite arced portions forming corresponding cylinder segments. As can be seen in FIG. 8*c*, the hole 21 in the coupling part 20' receiving the transmitter 12 may have a polygonal shape instead of a circular shape as shown in FIG. 8*b*.

The embodiment of FIG. 8*d* differs only slightly from the embodiment of FIG. 8*b* regarding the design of the interface between the coupling part 20" and the cutter element 6 (not shown). In FIG. 8*d* the neck portion 34 of the coupling part 20" is provided with an end in the form of a ball segment 36, which may be received in a corresponding guidance chamber having two opposite arced portions forming corresponding cylinder segments.

Figure 9:
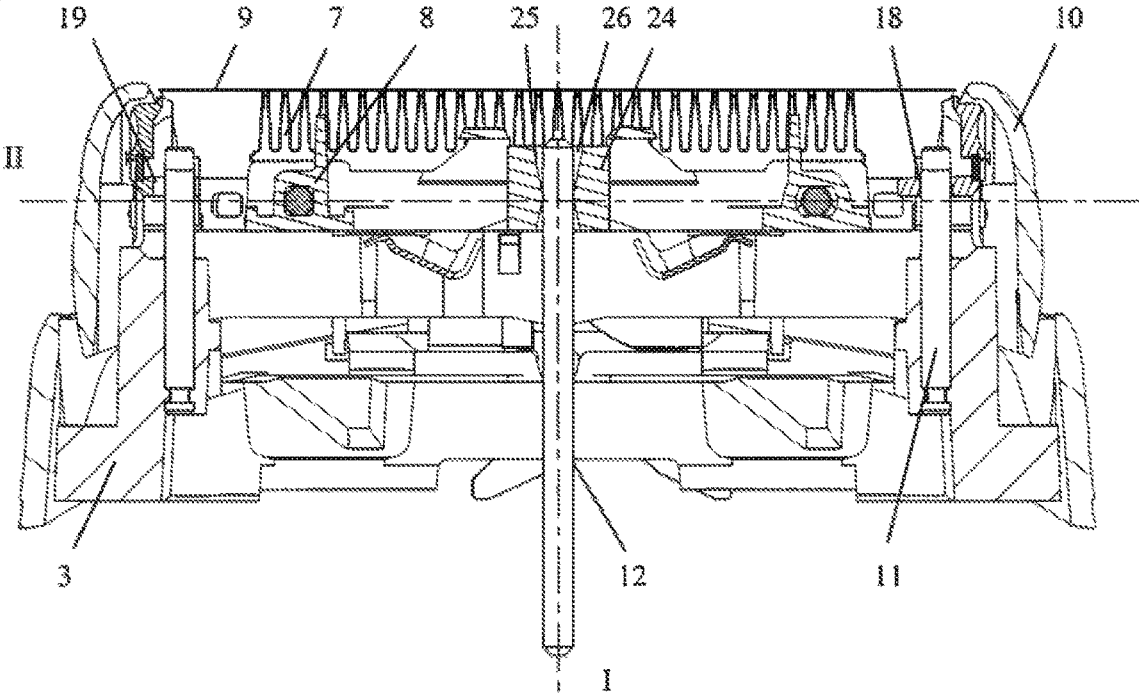
FIG. 9 is a sectional view of a shaver head according to an eighth embodiment of the invention.

A further embodiment of the invention is depicted in FIG. 9 which differs from the above mentioned embodiments in that a coupling part 24 is not a separate component part but an integral portion of the base 8 of the lower cutter element 6.

The coupling part 24 is defined by two apposed side surfaces 25 which are arranged on opposite sides as seen in the direction of the horizontal cutter oscillation axis II. In the embodiment depicted in FIG. 9 the side surfaces 25 are roof-shaped with two portions which are inclined with respect to the vertical axis I and which form an obtuse angle with respect to each other. As an alternative, the side surfaces 25 may have a bent configuration or may be formed by portions forming an acute angle. Such a design of the side surfaces results in the coupling part 24 defining a slotted hole for receiving the transmitter pin 12. As can be seen in FIGS. 6*a* and 6*b* the arrangement of the side surfaces 25 is such that a middle portion of the slotted hole 26 has a width substantially corresponding to the width of the transmitter pin 12 in the direction of the horizontal cutter oscillation axis II, while the width of the slotted hole 26 exceeds the width of the transmitter pin 12 in an upper portion and in a lower portion. Further, the width of the slotted hole 26 exceeds the width of the transmitter pin 12 in a direction parallel to the tilting axis III. The transmitter pin 12 is guided in the slotted hole 26 to allow vertical translation and forward horizontal translation of base 8 with respect to transmitter pin 12 while blocking relative lateral horizontal translation. In addition, gyration, swiveling and tilting of base 8 with respect to transmitter pin 12 is allowed by due to the design and arrangement of the side surfaces 25.

Figure 10A:
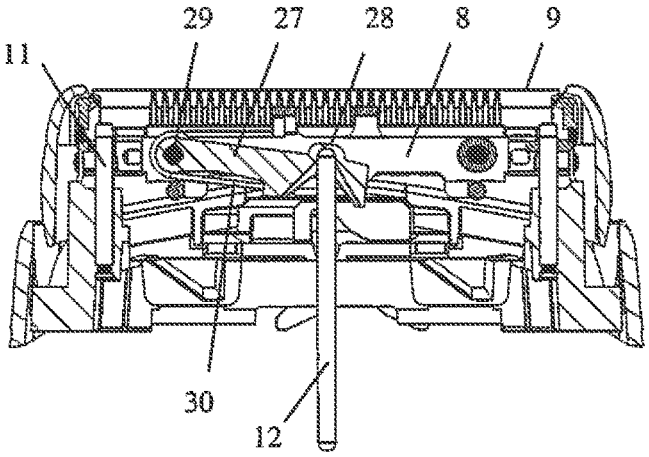
FIG. 10*a* is a sectional view of a shaver head according to a ninth embodiment of the invention.
Figure 10B:
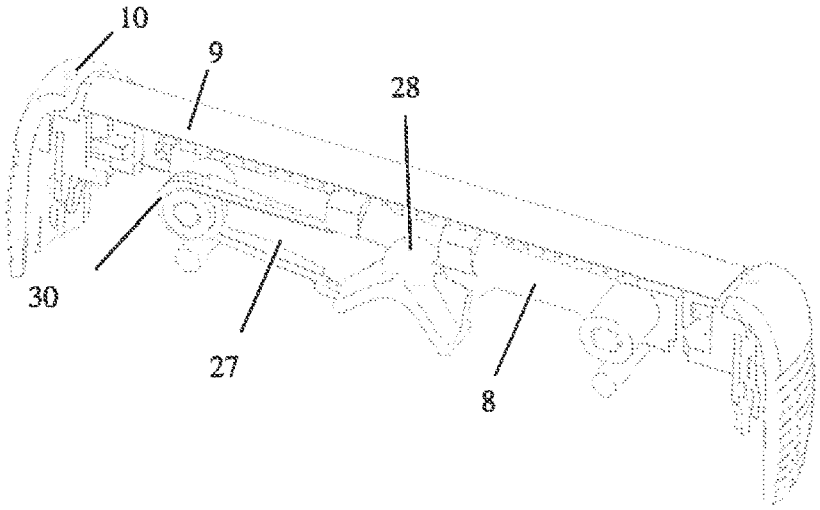
FIG. 10*b* is a perspective partial view of a detail of the shaver head of FIG. 10*a*.

A further embodiment of the invention is depicted in FIGS. 10*a* and 10*b*. While the general composition and function of the component parts of the shaver head 3 is identical to the above described embodiments, the coupling between the transmitter pin 12 and the lower cutter element 6 differs in the provision of a coupling part in the form of a con-rod 27 having a bearing shell 28 at one end. The con-rod 27 is attached to the base 8 of the lower cutter element 6 with its opposite end by means of a pivot bearing 29. A leg spring 30 engages the con-rod 27 and the base 8 of the lower cutter element 6, thereby biasing the bearing shell 28 away from the lower cutter element 6.

In the depicted embodiment the bearing shell 28 has the form of a hemisphere passing into a truncated cone. The bearing shell 28 receives the upper end of transmitter pin 12 which may have a rounded tip. The transmitter pin 12 is guided within bearing shell 28 such that a lateral horizontal translation is transmitted from the transmitter pin 12 via the con-rod 27 to the base 8 of lower cutter element 6. However, gyration, swiveling and tilting of the transmitter pin 12 with respect to bearing shell 28 is permitted. In addition, a vertical translation of the lower cutter element 6 with respect to the transmitter pin 12 is permitted by pivoting con-rod 27 against the bias of leg spring 30.

In the exemplary embodiments depicted in the figures, the coupling between the transmitter pin 12 and the lower cutter element 6 is identical for both cutter units 4. However, different interfaces between the transmitter pin 12 and a cutter unit 4 may be provided if desired to allow differing relative movements between the cutter unit and the transmitter pin. Cutter unit 5 may be driven together with one of the cutter units 4 by a common transmitter pin 12.

It is a common feature of the above described embodiments that the coupling is designed to allow relative vertical translation, relative forward horizontal translation, relative gyration, relative swiveling and/or relative tilting of a cutter unit with respect to a transmitter pin on a macroscopic level, i.e. based on a movement of the whole shaver head 3 with respect to the housing 2, and/or on a microscopic level, i.e. based on a movement of a cutter unit 4, 5 relative to the shaver head 3. This permits a perfect adaption of the position of each individual cutter unit 4, 5 with respect to the contour of the skin to be shaved.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

LIST OF REFERENCE SIGNS

| | |
|---|---|
| 1 | electrical shaver |
| 2 | housing |
| 3 | shaver head |
| 4 | cutter unit |
| 5 | cutter unit |
| 6 | lower cutter element |
| 7 | blade |
| 8 | base |
| 9 | upper cutter element |
| 10 | cartridge/wing |
| 10a, b | cartridge portion/wing |
| 11 | pin |
| 12 | transmitter pin |
| 13 | coupling part |
| 14 | slotted hole |
| 15 | guide pin |
| 16 | coupling part |
| 17 | lateral cylindrical portion |
| 18 | fixed bearing |
| 19 | floating bearing |
| 20 | coupling part |
| 20' | coupling part |
| 20" | coupling part |
| 21 | circular hole |
| 22 | leg |
| 23 | compression spring |
| 24 | coupling part |
| 25 | side surface |
| 26 | slotted hole |
| 27 | con-rod |
| 28 | bearing shell |
| 29 | pivot bearing |
| 30 | leg spring |
| 31 | gimbal element |
| 32 | arm |
| 33 | frame |
| 34 | neck |

-continued

| | |
|---|---|
| 35 | protrusion |
| 36 | ball |
| I | vertical axis |
| II | horizontal cutter oscillation axis |
| III | horizontal tilting axis |

What is claimed is:

1. An electric shaver comprising:

a. a shaver handle housing, b. a shaver head housing coupled with said shaver handle housing, said shaver head housing being provided with at least one wing, c. wherein the wing comprises at least one cutter unit with a first cutter element and a second cutter element, said shaver handle comprising a motor, said motor being coupled with a drive unit for driving either said first cutter element and/or said second cutter element in an oscillating manner along a first horizontal cutter oscillation axis, d. wherein said at least one cutter unit is arranged in the at least one wing, wherein said shaver head is tiltably supported by said shaver handle about a second horizontal tilting axis wherein the first horizontal cutter oscillation axis being perpendicular to a vertical axis and perpendicular to the second horizontal tilting axis, e. wherein the at least one wing is supported pivotably relative to the shaver head housing.

2. The electric shaver according to claim 1, wherein said shaver head housing comprises two wings each being provided with at least one cutter unit, said wings are pivotably supported within said shaver head housing such that both wings swivel dependent together or independently form each other.

3. The electric shaver according to claim 2, wherein said at least one cutter unit is moveably supported within the at least one wing.

4. The electric shaver according to claim 1 wherein each cutter unit is mounted in the at least one wing pivotably about the second horizontal tilting axis relative to the shaver head and axially displaceably parallel to a vertical axis relative to the shaver head, with the first horizontal cutter oscillation axis being perpendicular to the vertical axis and perpendicular to the second horizontal tilting axis, and wherein the at least one wing is supported pivotably relative to the shaver head.

5. The electric shaver according to claim 1, wherein the at least one wing comprises at least two cutter units which are coupled with each other such that pivoting about the second horizontal tilting axis and/or displacement parallel to the vertical axis of a first cutter unit mounted in said wing causes pivoting about the second horizontal tilting axis and/or displacement parallel to the vertical axis of a further cutter unit mounted in said wing.

6. The electric shaver according to claim 1, wherein the wing is divided into at least two portions, which are provided to be independently movable with respect to each other, wherein each portion comprises at least one cutter unit.

7. The electric shaver according to claim 1, wherein the wing fully or partly envelopes the shaver head or the shaver head fully or partly envelopes the wing.

8. The electric shaver according to claim 7, wherein the shaver head is mounted in or on said shaver housing pivotably about the first horizontal cutter oscillation axis relative to the shaver housing.

9. The electric shaver according to claim 1, wherein the first cutter element is a foil type cutter element and that the second cutter element is a blade type cutter element.

10. The electric shaver according to claim 1, further comprising a drive unit located at least in part within the shaver housing, said drive unit being mounted at the shaver housing and stationary relative to said tiltable shaver head.

11. The electric shaver according to claim 10, wherein the drive unit is coupled to the second cutter element by means of a coupling, the coupling comprising a transmitter, the second cutter element and a coupling part, wherein the coupling part comprises a seat for receiving the transmitter, and wherein the transmitter, the cutter element and the coupling part are arranged and formed such that the transmitter is constrained to the cutter element in a direction parallel to the first horizontal cutter oscillation axis while having a degree of freedom in at least two rotational directions and in at least one translational direction parallel to the vertical axis.

12. The electric shaver according to claim 11, the transmitter is rotatable relative to the coupling part around the vertical axis and that the coupling part is rotationally constrained to the second cutter element in the rotational direction around the vertical axis, wherein the coupling part comprises an at least in part spherical or cylindrical outer surface and the second cutter element comprises a corresponding at least in part spherical or cylindrical inner surface.

13. The electric shaver according to claim 12, wherein the coupling part comprises a bearing shell receiving the free end of the transmitter, wherein the bearing shell is mounted to the second cutter element via a con-rod which is pivotable about an axis perpendicular to the first horizontal cutter oscillation axis and perpendicular to the vertical axis.

14. The electric shaver according to any of claim 13, wherein the at least one cutter unit is gimbal-mounted on the shaver housing and/or shaver head.

15. The electric shaver according to any of claim 14, wherein the at least one cutter unit is mounted to the shaver housing and/or shaver head by elastically deformable connecting elements.

16. The electric shaver according to any of claim 15, further comprising at least one elastically deformable biasing element, wherein the elastically deformable biasing element biases the second cutter element at least in a direction parallel to the vertical axis into a home position, and/or biases the cartridge into a neutral rest position.

* * * * *